US005274383A

United States Patent [19]

Godet

[11] Patent Number: 5,274,383

[45] Date of Patent: Dec. 28, 1993

[54] JAMMER SIGNAL REJECTION ARRANGEMENT FOR A PHASED ANTENNA ARRAY

[75] Inventor: Sidney Godet, Little Falls, N.J.

[73] Assignee: ITT Corporation, New York, N.Y.

[21] Appl. No.: 951,415

[22] Filed: Oct. 13, 1978

[51] Int. Cl.[5] ..... H01Q 3/22; H01Q 3/24; H01Q 3/26

[52] U.S. Cl. ..... 342/373

[58] Field of Search ..... 343/100 SA, 854; 342/373

*Primary Examiner*—Theodore M. Blum

*Attorney, Agent, or Firm*—Thomas N. Twomey; Patrick M. Hogan

[57] ABSTRACT

The arrangement includes N inputs each having an input signal thereon from a different one of N groups of elements of a phased antenna array, where N is an even integer greater than one and where the array is pointed only at a desired signal source, a first circuit to produce from the input signals M sum signals each having the desired signal received by the array and at least one jammer signal and M difference signals each having only the jammer signal, where M is an integer, and a second circuit responsive to each of the M sum signals and at least a selected one of the M difference signals to produce a resultant output signal having the desired signal with the jammer signal eliminated or at least greatly reduced.

40 Claims, 4 Drawing Sheets

JAMMER SIGNAL REJECTION ARRANGEMENT FOR A PHASED ANTENNA ARRAY

BACKGROUND OF THE INVENTION

This invention relates to phased antenna arrays and more particularly to a jammer signal rejection arrangement for such arrays.

Jammer rejection arrangements for phased antenna arrays as described in the technical literature control the phase and amplitude of the received signal from each element of the phased antenna array in an attempt to create a pattern null in the direction of each existing jammer signal source.

Another approach was described by S. P. Applebaum, Syracuse University Research Corporation, in which an antenna beam is pointed at the jammer signal source, in addition to an antenna beam being pointed at the desired signal source, and correlation between the signal outputs resulting from these two beams is used to neutralize the jammer signal in the desired signal.

The disadvantages of the null generating arrangement are that it is horribly complex for practical array sizes, it requires the use of a fast digital computer with large memory, independent means must be used to distinguish the desired signal from the jammer signals, and for several jammer sources, overall stability is dependent upon a large number of variable factors which are difficult to define in a practical situation.

The Applebaum arrangement is limited in performance, even with a single jammer, because of the Presence of the desired signal in the beam pointed at the jammer signal source. There is no information on how the Applebaum arrangement handles the multiple jammer situation.

SUMMARY OF THE INVENTION

An object of the present invention is to provide an improved jammer signal rejection arrangement for a phased antenna array.

Another object of the present invention is to provide a jammer signal rejection arrangement for a phased antenna array overcoming the above-mentioned disadvantages of the above-mentioned prior art jammer signal rejection arrangements.

A feature of the present invention is the provision of an arrangement to reject at least one undesired signal received by a phased antenna array comprising: N inputs each having an input signal thereon from a different one of N groups of elements of the array, where N is an even integer greater than one; first means coupled to each of the N inputs to produce from the input signals M sum signals each having a desired signal received by said array and the undesired signal and M difference signals each having only the undesired signal where M is an integer; and second means coupled to the first means responsive to each of the M sum signals and at least a selected one of the M difference signals to produce a resultant output signal having the desired signal with the undesired signal eliminated or at least greatly reduced.

As will be described hereinbelow, the jammer signal rejection arrangement of the present invention overcomes the disadvantages of the above-described prior art arrangements since the system proposed is not very complex and does not require a digital computer, it is not necessary to know the characteristics of the desired signal, it is necessary to know only the direction in space from which the desired signal is arriving at the array, and the stability is entirely predictable, independent of any characteristics of either the desired or the jamming signals.

The jammer signal rejection arrangement proposed is similar to the Applebaum arrangement, except that, instead of directing an antenna beam towards the jammer, signals are formed from the array beams which null out the desired signal (whose direction is known) but allow the jammer signals (with unknown directions) to appear as signal outputs. For a single jammer, this proposed system has a performance limited only by hardware imperfections.

BRIEF DESCRIPTION OF THE DRAWING

Above-mentioned and other features and objects of this invention will become more apparent by reference to the following description taken in conjunction with the accompany drawing, in which.

DESCRIPTION OF THE PREFERRED EMBODIMENT

Figure 1:
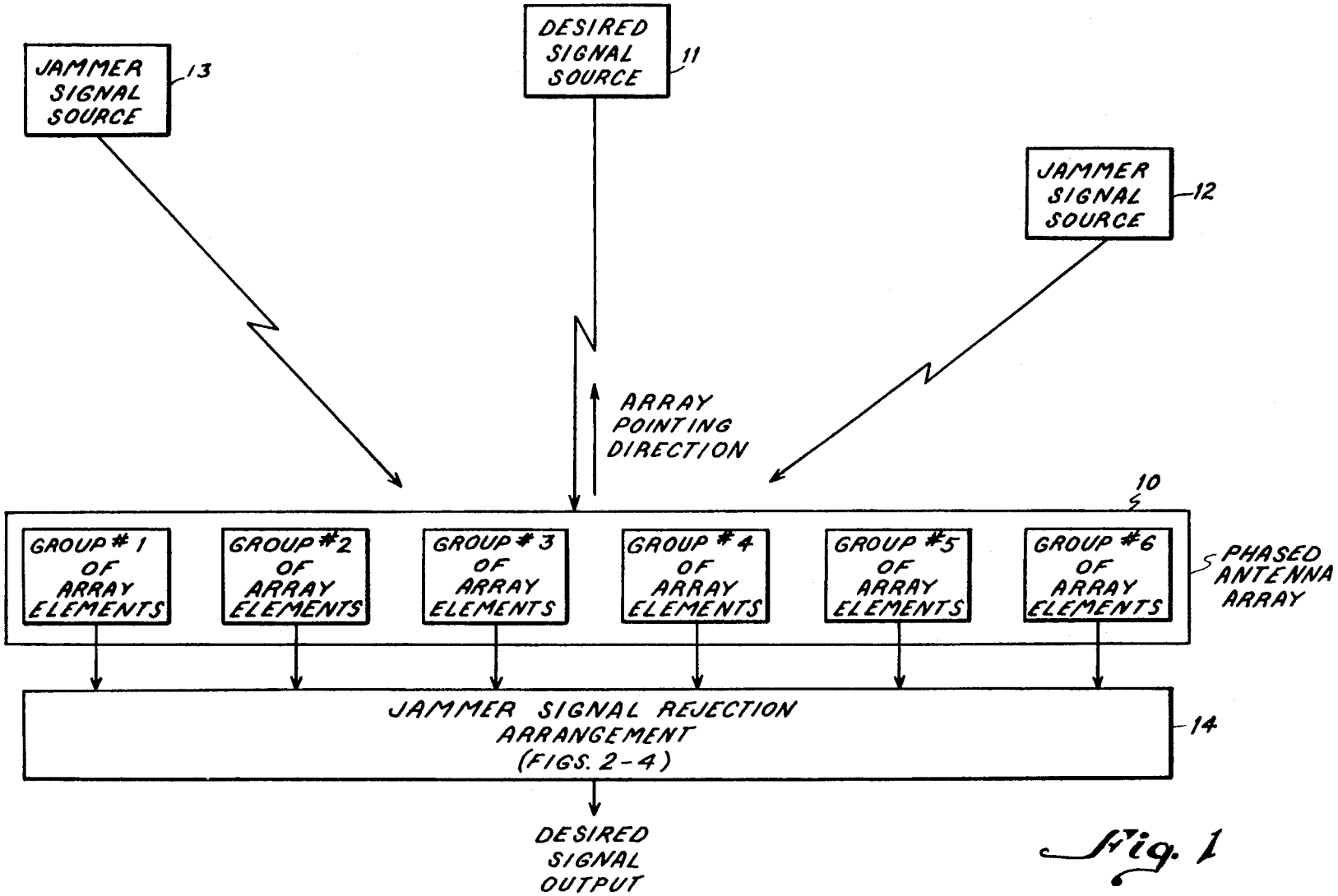
FIG. 1 is a block diagram illustrating the relationship between the phased antenna array and the desired and jammer signal sources with the array elements arranged in groups for operation with the jammer signal rejection arrangement in accordance with the principles of the present invention.

Referring to FIG. 1, it is illustrated therein that the phased antenna array 10 is pointed only in the direction of the desired signal source 11 with the signals from one or more jammer signal sources 12 and 13 arriving at array 10 at an unknown direction. The elements of array 10 are arranged in groups of a plurality of array elements; namely, groups #1–#6. The signal on each of the elements of each of the group of array elements are combined to provide a single signal output from each of the groups of array elements #1–#6. The output signals from groups of array elements are coupled to the jammer signal rejection arrangement 14 which in accordance with the principles of the present invention produces a resultant output signal having the desired signal with the undesired or jamming signal eliminated in the case of a single jammer or greatly reduced in the case of multiple jammers.

Figure 2:
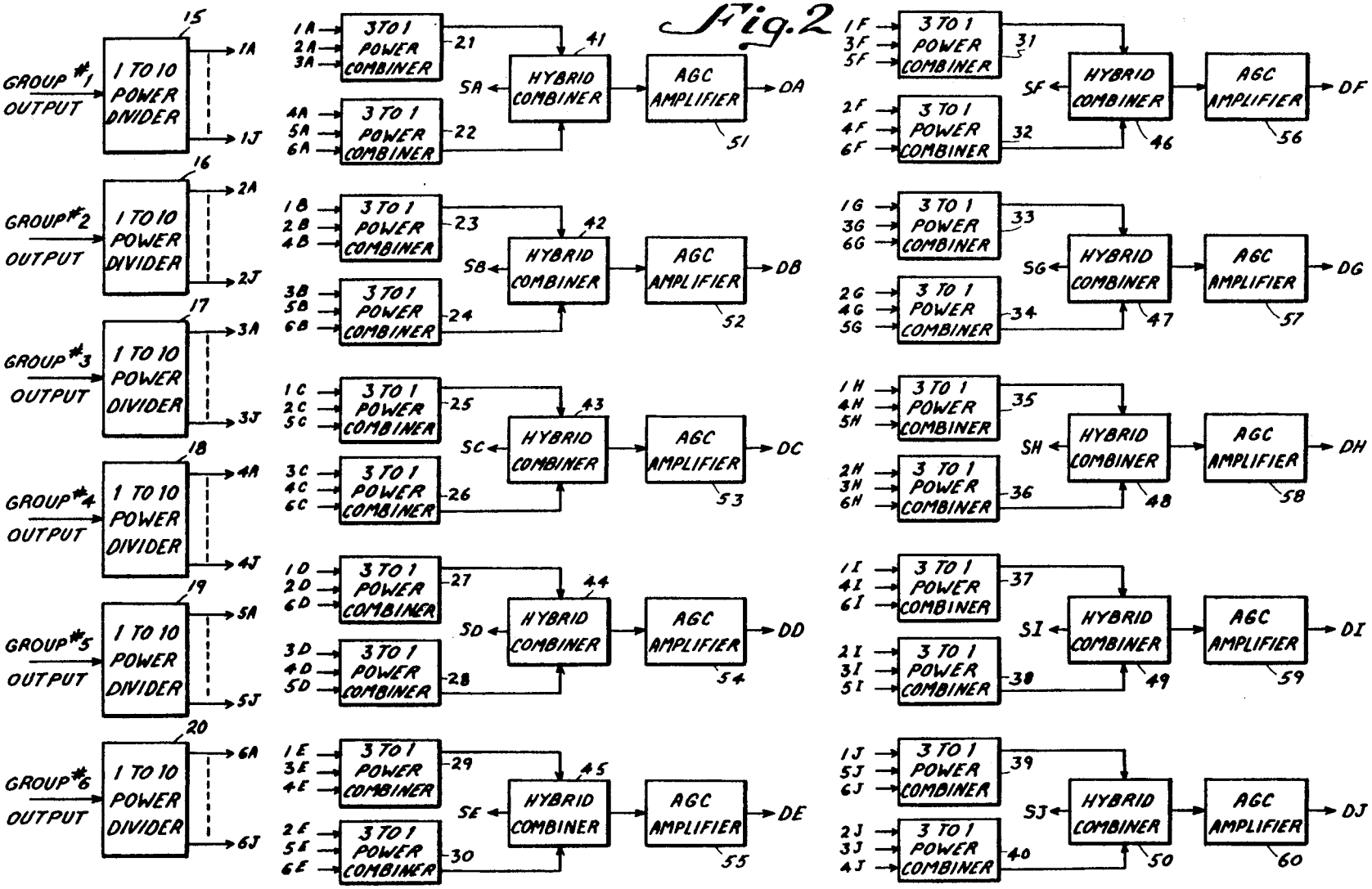
FIGS. 2–4 are block diagrams which when taken together illustrate the jammer signal rejection arrangement in accordance with the principles of the present invention.

The jammer signal arrangement 14 will now be described with reference to FIGS. 2–4 which when taken together fully illustrate the circuitry incorporated in arrangement 14.

As mentioned with respect to FIG. 1, the phased antenna array 10 is divided into a number of groups of array elements with each group having the same number of array elements. As an example for purposes of explanation, the array elements are divided into six groups with the output from each group being coupled to a different one of the 1-to-10 power dividers 15–20. Dividers 15–20 split the output signals from each of the groups #1–#6 into ten equal signal components. These signal components are combined, three at a time, in all combinations of the signal components produced in dividers 15–20, in the 3-to-1 power combiners 21–40.

Each complementary pair of combinations is fed into a different one of hybrid combiners 41-50 which give outputs SA-SJ which represent the sum of the combinations and also give outputs feeding into a different one of the AGC amplifiers 51-60 which represent the difference of the combinations. The AGC'ed difference signals are identified as signals DA-DJ. Since each group of array elements is pointed at the desired signal source, the desired signal component in each combination of three signal components will be equal to that in all other combinations. Consequently, each difference signal DA-DJ will have no desired signal. The sum signals SA-SJ will each have the same desired signal plus the undesired jammer signal, which will in general be different for each of the sum signals. If the sum signals are added together in a 10-to-1 power combiner 61 (FIG. 3), then the desired signals of each of the sum signals will add coherently, whereas the jammer signal components will have some degree of noncoherence.

Each of the difference signals DA-DJ will consist of the jammer signal only, but the relative phase angle (relative to the desired signal, or, for multiple jammers, relative to each other) will be distributed in a random manner among the ten difference signals, depending upon direction of the jammer signal sources and the space distribution of the elements of the phased antenna array. For purposes of maintaining constant loop gain in the correlator units of FIG. 3, each difference signal output from hybrid combiners 41-50 is AGC'ed in amplifiers 51-60 to a predetermined level, with a time constant to be determined dependent on the specific application involved, resulting in the difference signals DA-DJ.

The desired signal with the jammer signal eliminated in the case of a single jammer signal source or the jammer signal greatly reduced in the case of multiple jammer signal sources is provided by a correlation circuit which is responsive to the combined sum signals SA-SJ and at least a selected one of the difference signals DA-DJ. This correlation circuit is illustrated in FIG. 3 and comprises circuitry to provide two correlations. For the first correlation two correlator units 62 and 63 are used. Each of the two correlator units 62 and 63 derives its sum signal input from combiner 61 through power divider 64. The difference signal inputs of each of the units 62 and 63 are capable of being switched to any one of the ten difference signals DA-DJ. The switches SW1-SW3, logic and switch drivers 65 and the amplitude comparator 66 are used to select the difference signal input which yields the minimum power output from correlator units 62 and 63. Since the desired signal output is the same regardless of which difference beam is used, the minimum total power output in the output signals of units 62 and 63 represents the minimum jammer power contained in the resultant output signal. If there is only one jammer signal source present, the jammer signal will be completely eliminated for any difference beam. In this case, all total power outputs will be the same, and it will not make any difference which difference beam is selected. For multiple jammer signal sources, the optimum difference signal will be selected.

Figures 3, 4:
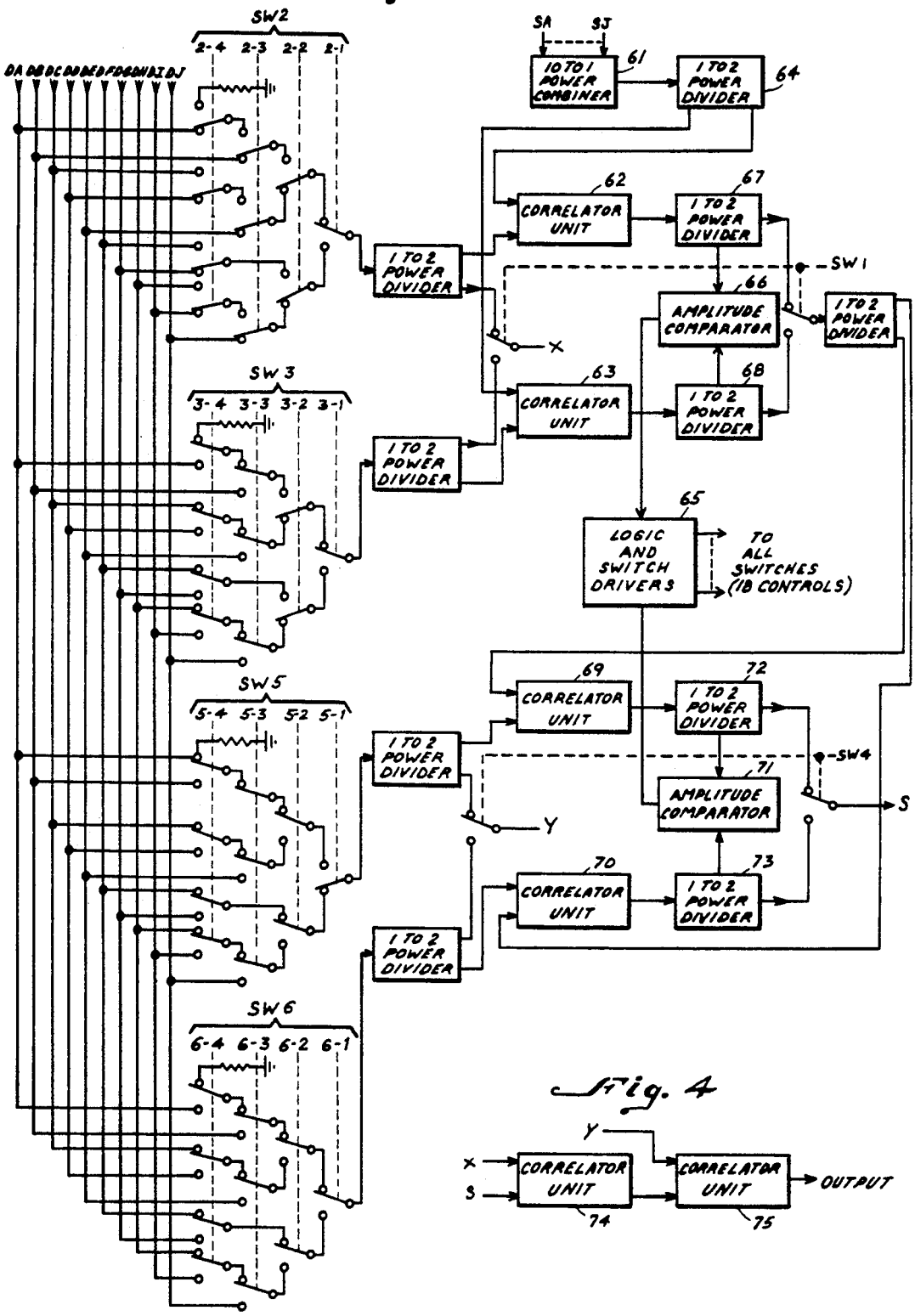

The jamming signal component can be further reduced by a second correlation employing the circuitry shown in the bottom half of FIG. 3 which includes correlator units 69 and 70, switches SW4-SW6, logic and switch drivers 65, amplitude comparator 71 and power dividers 72 and 73. The same switching and selection process is used in the second correlation as was used in the first correlation, resulting in the selection of an optimum difference signal for the second correlation and a desired signal with a minimum jammer signal component at the output S. The optimum difference signal for the second correlation will not be the same as that for the first correlation. If the same difference beam were used, then no improvement would result from the second correlation.

The output X associated with switch SW1 provides the optimum difference signal for the first correlation and the output Y associated with switch SW4 provides the optimum difference signal for the second correlation.

Third and fourth correlations are possible by employing correlator units 74 and 75 of FIG. 4. Switching and selection are not necessary for these correlations, because alternate use of the signals at the outputs X and Y as the difference signal inputs will always provide optimum results. Thus, the S output of FIG. 3 is coupled as the sum input to correlator unit 74 and the X output of FIG. 3 is coupled as the difference input to correlator unit 74. The output of correlator unit 74 is the sum input to correlator unit 75 and the Y output of FIG. 3 is the difference input of correlator unit 75.

The number of correlations to be used after the second correlation is arbitrary. Some theoretical improvement can be achieved with each added correlation, but the amount of improvement decreases for each additional correlator unit. Therefore, the theoretical improvement must be traded off against cost and hardware noise. The total number of four correlations was chosen as an example, but the arrangement of the present invention can use any number of correlations.

The requirements for the logic circuitry of logic and switching drivers 65 to achieve the switching and selection of the optimum difference signal for correlation is as follows:

(1) Alternate between cycle I and cycle II.

(2) During cycle I:

- (a) Set switch SW1 to the smaller output of correlator units 62 and 63.
- (b) Set switch SW5 (for switch SW4 down) or switch SW6 (for switch SW4 up) to the off position.
- (c) Search through switch SW2 (for switch SW1 down) or search through switch SW3 (for switch SW1 up), omitting the two positions which are connected to switch SW1.

(3) During cycle II:

- (a) Set switch SW4 to the smaller output of correlator units 69 and 70.
- (b) Set switch SW2 (for switch SW1 down) or switch SW3 (for switch SW1 up) to the off position.
- (c) Search through switch SW5 (for switch SW4 down) or search through switch SW6 (for switch SW4 up), omitting the two positions which are connected to switch SW4.

Figure 5:
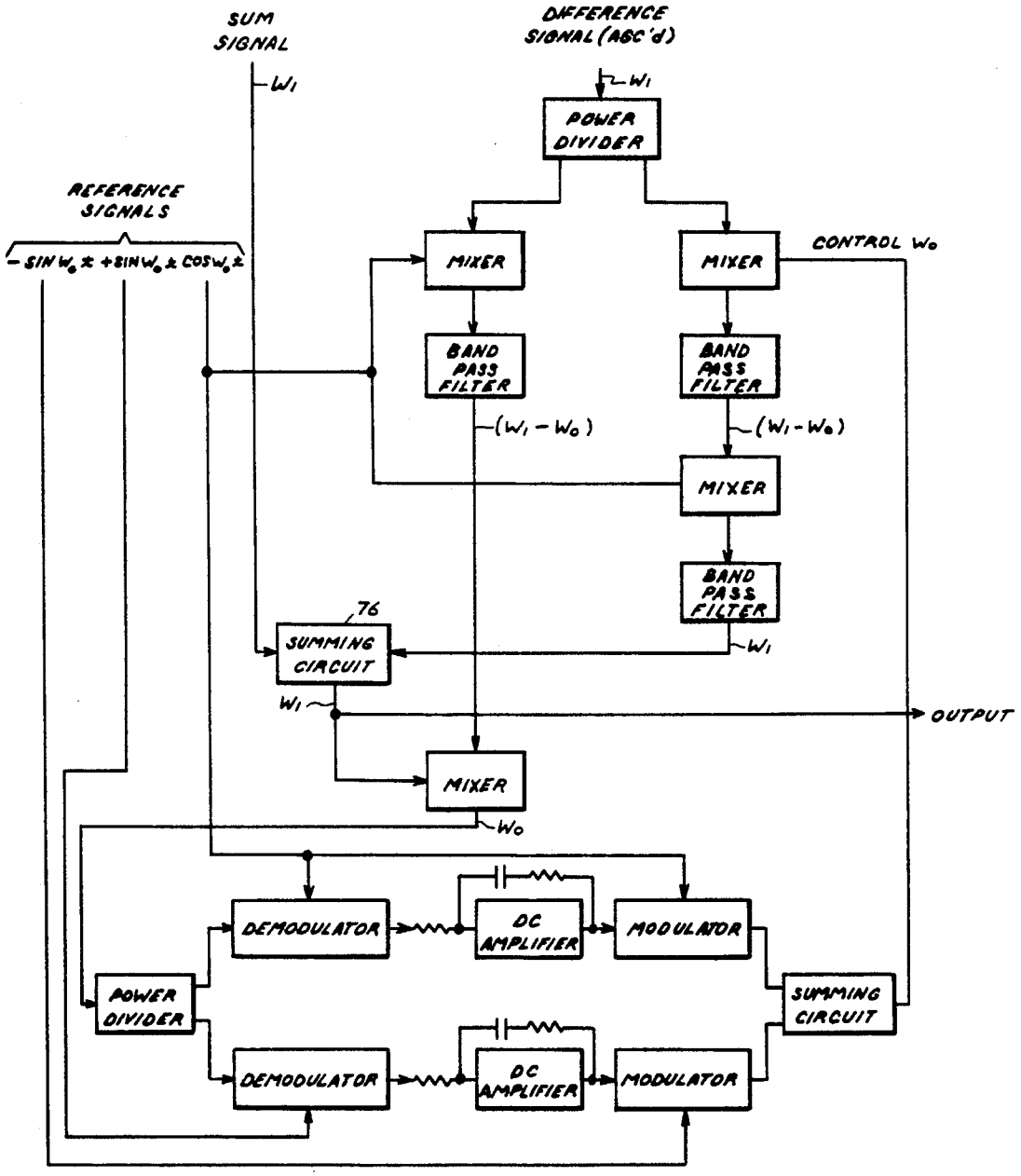
FIG. 5 is a block diagram of the correlator units incorporated in the circuit of FIG. 3.

Referring to FIG. 5, there is illustrated therein a block diagram of a correlator unit that may be employed in correlator units 62, 63, 69, 70, 74 and 75. This correlator unit accepts a sum and a difference signal and controls the amplitude and phase of a modified difference signal which is to be added to the sum signal in summing circuit 76 to effectively neutralize the jamming signal in the sum signal. This correlation unit per se is not novel and represents a standard technique described in the technical literature. FIG. 5 is included herein for completeness of the disclosure.

It should be noted that the number of array element groups, the number of sum and difference beams, and the number of successive correlation processes are all arbitrary, and better performance can be expected as these numbers are increased. For a given requirement, the numbers would be selected based upon a trade-off with cost, reliability and hardware noise. The six groups of array elements, the ten sum and difference signals and the four correlation arrangements have been chosen for this disclosure as typical values only.

In summary, the arrangement of the present invention will provide theoretically complete cancellation of the jammer signal when only one jammer signal source is present. For two jammer signal sources, the median improvement factor for the worst case jammer signal power ratio is about 29 decibels. For randomly distributed jammer signal power ratio, the median improvement factor will be much higher, depending upon the assumed distribution of the power ratio.

The jammer signal rejection arrangement of the present invention can be employed in any communication or data transmission system where the desired signal comes from known direction, and where the threat of intentional jamming is present.

While I have described above the principles of my invention in connection with specific apparatus it is to be clearly understood that this description is made only by way of example and not as a limitation to the scope of my invention as set forth in the objects thereof and in the accompanying claims.

I claim:

1. An arrangement to reject at least one undesired signal received by a phased antenna array comprising:
   N inputs each having an input signal thereon from a different one of N groups of elements of said array, where N is an even integer greater than one;
   first means coupled to each of said N inputs to produce from said input signals M sum signals each having a desired signal received by said array and said undesired signal and M difference signals each having only said undesired signal where M is an integer; and
   second means coupled to said first means responsive to each of said M sum signals and at least a selected one of said M difference signals to produce a resultant output signal having said desired signal with said undesired signal eliminated or at least greatly reduced.

2. An arrangement according to claim 1, wherein each of said N groups of elements is pointed only at said desired signal.

3. An arrangement according to claim 2, wherein said first means includes
   N third means each coupled to a different one of said N inputs to produce from each of said input signals M signal components,
   M pairs of fourth means, each pair said M pairs of fourth means being coupled to said N third means, said M pairs of fourth means combining said NM signal components N/2 at a time, and
   M fifth means each coupled to a different pair of said M pairs of fourth means to produce one of said M sum signals and one of said M difference signals.

4. An arrangement according to claim 3, wherein each of said N third means includes
   a power divider.

5. An arrangement according to claim 4, wherein each of said M pairs of fourth means includes
   a pair of power combiners.

6. An arrangement according to claim 5, wherein each of said M fifth means includes
   a hybrid combiner coupled to a different pair of said M pairs of power combiners to produce said one of said M sum signals, and
   an automatic gain controlled amplifier coupled to said hybrid combiner to produce said one of said M difference signals.

7. An arrangement according to claim 3, wherein each of said M pairs of fourth means includes
   a pair of power combiners.

8. An arrangement according to claim 7, wherein each of said M fifth means includes
   a hybrid combiner coupled to a different pair of said M pairs of power combiners to produce said one of said M sum signals, and
   an automatic gain controlled amplifier coupled to said hybrid combiner to produce said one of said M difference signals.

9. An arrangement according to claim 3, wherein each of said M fifth means includes
   a hybrid combiner coupled to a different pair of said M pairs of fourth means to produce said one of said M sum signals, and
   an automatic gain controlled amplifier coupled to said hybrid combiner to produce said one of said M difference signals.

10. An arrangement according to claim 3, wherein said second means includes
   at least a first correlation means coupled to each of said M fifth means, said first correlation means being responsive to each of said M sum signals and a selected one of said M difference signals to provide a first output signal having minimum total power.

11. An arrangement according to claim 10, wherein said first correlation means includes
   a first correlator unit having an output, a first input and a second input coupled to a first output of each of said M fifth means providing said one of said M sum signals,
   a second correlator unit having an output, a first input and a second input coupled to said first output of each of said M fifth means,
   first comparator means coupled to said output of each of said first and second correlator units to detect which of said first and second correlator units provides said first output signal having minimum total power, and
   switching means having at least a first portion coupled to said output of each of said first and second correlator units to select said first output signal having minimum total power, a second portion coupled to a second output of each of said M fifth means providing said one of said M difference signals and said first input of each of said first and second correlator units to couple a first of said M difference signals to said first correlator unit and a second of said M difference signals to said second correlator unit, one of said first and second of said M difference signals producing said first output signal having minimum total power at said output of one of said first and second correlator units, and a third portion coupled to an output of said first comparator means and each of said first and second portions to control said first and second portions.

12. An arrangement according to claim 11, wherein said second means further includes a second correlation means having a third correlator unit having an output, a first input and a second input coupled to said first portion of said first switching means responsive to said first output signal having minimum total power, a fourth correlator unit having an output, a first input and a second input coupled to said first portion of said first switching means responsive to said first output signal having minimum total power, a second comparator means coupled to said output of each of said third and fourth correlator units to detect which of said third and fourth correlator units provides a second output signal having minimum total power, and said switching means further includes a fourth portion coupled to said output of each of said third and fourth correlator units to select said second output signal having minimum total power and a fifth portion coupled to said second output of each of said M fifth means and said first input of each of said third and fourth correlator units to couple a third of said M difference signals to said third correlator unit and a fourth of said M difference signals to said fourth correlator unit, one of said third and fourth of said M difference signals producing said second output signal having minimum total power at said output of one of said third and fourth correlator units, said third portion being coupled to an output of said second comparator means and each of said fourth and fifth portions to control said fourth and fifth portions.

13. An arrangement according to claim 12, wherein said second means further includes a third correlation means having a fifth correlation unit coupled to said fourth portion and said second portion responsive to said second output signal having minimum total power and said one of said first and second of said M difference signals, and a sixth correlation unit coupled to the output of said fifth correlation unit and said fifth portion responsive to the output signal of said fifth correlation unit and said one of said third and fourth of said M difference signals to provide said resultant output signal.

14. An arrangement according to claim 10, wherein said second means further includes a second correlation means coupled to each of said M fifth means and said first correlation means, said second correlation means being responsive to a selected one of said M difference signals and said first output signal having minimum total power to provide a second output signal having minimum total power less than the minimum total power of said first output signal.

15. An arrangement according to claim 14, wherein said second means further includes a third correlation means coupled to said first correlation means and said second correlation means, said third correlation means being responsive to said second output signal having minimum total power, to said selected one of said M difference signals of said first correlation means and to said selected one of said M difference signals of said second correlation means to provide said resultant output signal.

16. An arrangement according to claim 2, wherein said second means includes at least a first correlation means coupled to said first means, said first correlation means being responsive to each of said M sum signals and a selected one of said M difference signals to provide a first output signal having minimum total power.

17. An arrangement according to claim 16, wherein said first correlation means includes a first correlator unit having an output, a first input and a second input coupled to said first means receiving each of said M sum signals, a second correlator unit having an output, a first input and a second input coupled to said first means receiving each of said M sum signals, first comparator means coupled to said output of each of said first and second correlator units to detect which of said first and second correlator units provides said first output signal having minimum total power, and switching means having at least a first portion coupled to said output of each of said first and second correlator units to select said first output signal having minimum total power, a second portion coupled to said first means and said first input of each of said first and second correlator units to couple a first of said M difference signals to said first correlator unit and a second of said m difference signals to said second correlator unit, one of said first and second of said M difference signals producing said first output signal having minimum total power at said output of one of said first and second correlator units, and a third portion coupled to an output of said first comparator means and each of said first and second portions to control said first and second portions.

18. An arrangement according to claim 17, wherein said second means further includes a second correlation means having a third correlator unit having an output, a first input and a second input coupled to said first portion of said first switching means responsive to said first output signal having minimum total power, a fourth correlator unit having an output, a first input and a second input coupled to said first portion of said first switching means responsive to said first output signal having minimum total power, a second comparator means coupled to said output of each of said third and fourth correlator units to detect which of said third and fourth correlator units provides a second output signal having minimum total power, and said switching means further includes a fourth portion coupled to said output of each of said third and fourth correlator units to select said second output signal having minimum total power and a fifth portion coupled to said first means and said first input of each of said third and fourth correlator units to couple a third of said M difference signals to said third correlator unit and a fourth of said M difference signals to said fourth correlator unit, one of said third and fourth of said M difference signals producing said second output signal having minimum total power at said output of one of said third and fourth correlator units, said third portion being coupled to an output of said second comparator means and each of said fourth and fifth portions to control said fourth and fifth portions.

19. An arrangement according to claim 18, wherein said second means further includes a third correlation means having a fifth correlation unit coupled to said fourth portion and said second portion responsive to said second output signal having minimum total power and said one of said first and second of said M difference signals, and a sixth correlation unit coupled to the output of said fifth correlation unit and said fifth portion responsive to the output signal of said fifth correlation unit and said one of said third and fourth of said M difference signals to provide said resultant output signal.

20. An arrangement according to claim 16, wherein said second means further includes a second correlation means coupled to said first means and said first correlation means, said second correlation means being responsive to a selected one of said M difference signals and said first output signal having minimum total power to provide a second output signal having minimum total power less than the minimum total power of said first output signal.

21. An arrangement according to claim 20, wherein said second means further includes a third correlation means coupled to said first correlation means and said second correlation means, said third correlation means being responsive to said second output signal having minimum total power, to said selected one of said M difference signals of said first correlation means and to said selected one of said M difference signals of said second correlation means to provide said resultant output signal.

22. An arrangement according to claim 1, wherein said first means includes N third means each coupled to a different one of said N inputs to produce from each of said input signals M signal components, M pairs of fourth means, each pair of said M pairs of fourth means being coupled to said N third means, said M pairs of fourth means combining said NM signal components N/2 at a time, and M fifth means each coupled to a different pair of said M pairs of fourth means to produce one of said M sum signals and one of said M difference signals.

23. An arrangement according to claim 22, wherein each of said N third means includes a power divider.

24. An arrangement according to claim 23, wherein each of said M pairs of fourth means includes a pair of power combiners.

25. An arrangement according to claim 24, wherein each of said M fifth means includes a hybrid combiner coupled to a different pair of said M pairs of power combiners to produce said one of said M sum signals, and an automatic gain controlled amplifier coupled to said hybrid combiner to produce said one of said M difference signals.

26. An arrangement according to claim 22, wherein each of said M pairs of fourth means includes a pair of power combiners.

27. An arrangement according to claim 26, wherein each of said M fifth means includes a hybrid combiner coupled to a different pair of said M pairs of power combiners to produce said one of said M sum signals, and an automatic gain controlled amplifier coupled to said hybrid combiner to produce said one of said M difference signals.

28. An arrangement according to claim 22, wherein each of said M fifth means includes a hybrid combiner coupled to a different pair of said M pairs of fourth means to produce said one of said M sum signals, and an automatic gain controlled amplifier coupled to said hybrid combiner to produce said one of said M difference signals.

29. An arrangement according to claim 22, wherein said second means includes at least a first correlation means coupled to each of said M fifth means, said first correlation means being responsive to each of said M sum signals and a selected one of said M difference signals to provide a first output signal having minimum total power.

30. An arrangement according to claim 29, wherein said first correlation means includes a first correlator unit having an output, a first input and a second input coupled to a first output of each of said M fifth means providing said one of said M sum signals, a second correlator unit having an output, a first input and a second input coupled to said first output of each of said M fifth means, first comparator means coupled to said output of each of said first and second correlator units to detect which of said first and second correlator units provides said first output signal having minimum total power, and switching means having at least a first portion coupled to said output of each of said first and second correlator units to select said first output signal having minimum total power, a second portion coupled to a second output of each of said M fifth means providing said one of said M difference signals and said first input of each of said first and second correlator units to couple a first of said M difference signals to said first correlator unit and a second of said M difference signals to said second correlator unit, one of said first and second of said M difference signals producing said first output signal having minimum total power at said output of one of said first and second correlator units, and a third portion coupled to an output of said first comparator means and each of said first and second portions to control said first and second portions.

31. An arrangement according to claim 30, wherein said second means further includes a second correlation means having a third correlator unit having an output, a first input and a second input coupled to said first portion of said first switching means responsive to said first output signal having minimum total power, a fourth correlator unit having an output, a first input and a second input coupled to said first portion of said first switching means responsive to said first output signal having minimum total power, a second comparator means coupled to said output of each of said third and fourth correlator units to detect which of said third and fourth correlator units provides a second output signal having minimum total power, and said switching means further includes a fourth portion coupled to said output of each of said third and fourth correlator units to select said second output signal having minimum total power and a fifth portion coupled to said second output of each of said M fifth means and said first input of each of said third and fourth correlator units to couple a third of said M difference signals to said third correlator unit and a fourth of said M difference signals to said fourth correlator unit, one of said third and fourth of said M difference signal producing said second output signal having minimum total power at said output of one of said third and fourth correlator units, said third portion being coupled to an output of said second comparator means and each of said fourth and fifth portions to control said fourth and fifth portions.

32. An arrangement according to claim 31, wherein said second means further includes a third correlation means having a fifth correlation unit coupled to said fourth portion and said second portion responsive to said second output signal having minimum total power and said one of said first and second of said M difference signals, and a sixth correlation unit coupled to the output of said fifth correlation unit and said fifth portion responsive to the output signal of said fifth correlation unit and said one of said third and fourth of said M difference signals to provide said resultant output signal.

33. An arrangement according to claim 29, wherein said second means further includes a second correlation means coupled to each of said M fifth means and said first correlation means, said second correlation means being responsive to a selected one of said M difference signals and said first output signal having minimum total power to provide a second output signal having minimum total power less than the minimum total power of said first output signal.

34. An arrangement according to claim 33, wherein said second means further includes a third correlation means coupled to said first correlation means and said second correlation means, said third correlation means being responsive to said second output signal having minimum total power, to said selected one of same M difference signals of said first correlation means and to said selected one of said M difference signals of said second correlation means to provide said resultant output signal.

35. An arrangement according to claim 1, wherein said second means includes at least a first correlation means coupled to said first means, said first correlation means being responsive to each of said M sum signals and a selected one of said M difference signals to provide a first output signal having minimum total power.

36. An arrangement according to claim 35, wherein said first correlation means includes a first correlator unit having an output, a first input and a second input coupled to said first means receiving each of said M sum signals, a second correlator unit having an output, a first input and a second input coupled to said first means receiving each of said M sum signals, first comparator means coupled to said output of each of said first and second correlator units to detect which of said first and second correlator units provides said first output signal having minimum total power, and switching means having at least a first portion coupled to said output of each of said first and second correlator units to select said first output signal having minimum total power, a second portion coupled to said first means and said first input of each of said first and second correlator units to couple a first of said M difference signals to said first correlator unit and a second of said M difference signals to said second correlator unit, one of said first and second of said M difference signals producing said first output signal having minimum total power at said output of one of said first and second correlator units, and a third portion coupled to an output of said first comparator means and each of said first and second portions to control said first and second portions.

37. An arrangement according to claim 36, wherein said second means further includes a second correlation means having a third correlator unit having an output, a first input and a second input coupled to said first portion of said first switching means responsive to said first output signal having minimum total power, a fourth correlator unit having an output, a first input and a second input coupled to said first portion of said first switching means responsive to said first output signal having minimum total power, a second comparator means coupled to said output of each of said third and fourth correlator units to detect which of said third and fourth correlator units provides a second output signal having minimum total power, and said switching means further includes a fourth portion coupled to said output of each of said third and fourth correlator units to select said second output signal having minimum total power and a fifth portion coupled to said first means and said first input of each of said third and fourth correlator units to couple a third of said M difference signals to said third correlator unit and a fourth of said M difference signals to said fourth correlator unit, one of said third and fourth of said M difference signals producing said second output signal having minimum total power at said output of one of said third and fourth correlator units, said third portion being coupled to an output of said second comparator means and each of said fourth and fifth portions to control said fourth and fifth portions.

38. An arrangement according to claim 37, wherein said second means further includes a third correlation means having a fifth correlation unit coupled to said fourth portion and said second portion responsive to said second output signal having minimum total power and said one of said first and second of said M difference signals, and a sixth correlation unit coupled to the output of said fifth correlation unit and said fifth portion responsive to the output signal of said fifth correlation unit and said one of said third and fourth of said M difference signals to provide said resultant output signal.

39. An arrangement according to claim 35, wherein said second means further includes a second correlation means coupled to said first means and said first correlation means, said second correlation means being responsive to a selected one of said M difference signals and said first output signal having minimum total power to provide a second output signal having minimum total power less than the minimum total power of said first output signal.

40. An arrangement according to claim 39, wherein said second means further includes a third correlation means coupled to said first correlation means and said second correlation means, said third correlation means being responsive to said second output signal having minimum total power, to said selected one of said M difference signals of said first correlation means and to said selected one of said M difference signals of said second correlation means to provide said resultant output signal.

* * * * *